US011254539B2

(12) United States Patent
Brereton

(10) Patent No.: US 11,254,539 B2
(45) Date of Patent: Feb. 22, 2022

(54) POCKET-SIZED DISPENSER FOR A SPOOL OF COILED MATERIAL

(71) Applicant: Leo Brereton, Weston, CT (US)

(72) Inventor: Leo Brereton, Weston, CT (US)

( * ) Notice: Subject to any disclaimer, the term of this patent is extended or adjusted under 35 U.S.C. 154(b) by 197 days.

(21) Appl. No.: 16/513,160

(22) Filed: Jul. 16, 2019

(65) Prior Publication Data

US 2020/0024101 A1 Jan. 23, 2020

Related U.S. Application Data

(60) Provisional application No. 62/764,106, filed on Jul. 17, 2018.

(51) Int. Cl.

| | |
|---|---|
| ***B65H 75/28*** | (2006.01) |
| ***B65H 75/14*** | (2006.01) |
| ***B65H 75/20*** | (2006.01) |
| ***B65H 75/26*** | (2006.01) |

(52) U.S. Cl.

CPC ..... *B65H 75/285* (2013.01); *B65H 75/14* (2013.01); *B65H 75/20* (2013.01); *B65H 75/26* (2013.01); *B65H 2402/41* (2013.01); *B65H 2402/44* (2013.01); *B65H 2701/113* (2013.01)

(58) Field of Classification Search

CPC .. B65H 35/002; B65H 37/005; B65H 49/205; B65H 75/406; B65H 2402/41; B65H 75/285; B65H 75/14; B65H 75/20; B65H 75/26; B65H 2701/113; B65H 2402/44; B65H 75/185; B65H 75/10; B65B 43/123; B65B 67/085

USPC ..... 242/596, 596.7, 596.8, 588, 588.1

See application file for complete search history.

(56) References Cited

U.S. PATENT DOCUMENTS

| | | | |
|---|---|---|---|
| 462,310 | A | 11/1891 | Gardner |
| 833,238 | A | 10/1906 | Pitschke |
| 1,687,819 | A | 10/1928 | Worthington |
| 4,860,893 | A | 8/1989 | Kaufinan |

(Continued)

FOREIGN PATENT DOCUMENTS

| | | | | |
|---|---|---|---|---|
| DE | 102007010431 | A1 * | 11/2007 | ..... B65H 16/106 |
| EP | 1185463 | B1 | 5/2004 | |

OTHER PUBLICATIONS

English Translation of DE 102007010431, "Holder for rolls has dog excrement bag of plastic foil, which is fastened with a vulcanized rubber provided with a cap whereby at an upper part, a roll is present having a larger circumference as a shell", Schultz, 2007 (Year: 2007).*

(Continued)

*Primary Examiner* — William A. Rivera

(74) *Attorney, Agent, or Firm* — Ware, Fressola, Maguire & Barber LLP

(57) ABSTRACT

A dispenser for holding a spool of coiled material utilizes a spindle having shoulder members at its ends respectively, and an elastic or resilient line extending between the shoulder members. The line traverses the outermost convolution of the coiled material, to resist free unwinding movement thereof. One of shoulder members is removable, to allow for insertion of a filled spool onto the spindle, for controlled dispensing of the coiled material. Simplicity in construction is realizable, along with compensation for gradual depletion of the coiled material as it is used up.

15 Claims, 2 Drawing Sheets

(56) References Cited

U.S. PATENT DOCUMENTS

| | | | | |
|---|---|---|---|---|
| 5,135,134 | A * | 8/1992 | Dancy | B65H 35/002 221/155 |
| 5,172,966 | A * | 12/1992 | Myatt | A47K 10/38 225/43 |
| 5,441,017 | A | 8/1995 | Lindsay | |
| 6,193,095 | B1 | 2/2001 | McNeil | |
| 6,257,473 | B1 | 7/2001 | Ringelstetter | |
| 6,460,799 | B1 | 10/2002 | Ryan | |
| 6,588,375 | B2 | 7/2003 | Benedettini | |
| 6,824,031 | B2 * | 11/2004 | McKenzie | A45F 3/14 224/666 |
| 7,392,921 | B1 | 7/2008 | McKenzie | |
| 8,113,381 | B2 | 2/2012 | Che | |
| 9,491,932 | B1 | 11/2016 | Becattini, Jr. et al. | |
| 2007/0241123 | A1 | 10/2007 | Che | |
| 2008/0173662 | A1 | 7/2008 | Che | |
| 2011/0240669 | A1 * | 10/2011 | Festa | B60R 15/02 221/45 |
| 2011/0272442 | A1 | 11/2011 | Che | |
| 2012/0104780 | A1 | 5/2012 | Lloyd et al. | |
| 2013/0248554 | A1 | 9/2013 | Robin | |
| 2015/0001332 | A1 | 1/2015 | Qin | |
| 2015/0014472 | A1 | 1/2015 | Hussain | |
| 2017/0275126 | A1 * | 9/2017 | Sudhir | B65H 35/002 |
| 2017/0370056 | A1 * | 12/2017 | McDonald | B65F 1/002 |

OTHER PUBLICATIONS

Amazon.com, "Dog Poop Bag Holder," https://www.amazon.com/Dispense-Effortlessly-Harness-Accidents-Reflective/dp/B01M5J253T, accessed Jun. 2019.

Chewy.com, "Dog Gone Smart, Dog Gone Smart I'm Gismo Dog Leash Handle with Poop Bag Dispenser," https://www.chewy.com/dog-gone-smart-im-gismo-dog-leash/dp/162374, accessed Jun. 2019.

Nitize.com, "Pack-A-Poo Dispenser + Refill bags," https://www.niteize.com/product/Pack-A-Poo-Bag-Dispenser.asp, accessed Jun. 2019.

Amazon.com, "Earth Rated Leash Dispenser for Dog Waste Bags," accessed Jun. 2019.

* cited by examiner

POCKET-SIZED DISPENSER FOR A SPOOL OF COILED MATERIAL

CROSS REFERENCE TO RELATED APPLICATIONS

The present application claims the benefit of U.S. Provisional Application No. 62/764,106 filed Jul. 17, 2018, which is hereby incorporated by reference in its entirety.

FIELD OF THE INVENTION

The present application relates generally to spools for sheet material, typically paper or plastic, and more particularly to dispensers for holding such spools and minimizing any tendency for uncontrolled unravelling of the material while it is being payed out from the spool.

BACKGROUND OF THE INVENTION

There are currently various products available on the market that are used for carrying or dispensing plastic bags when walking one's pets. However, these products are typically pouches, cases or containers that hold a roll of bags therein, which can be bulky for the user to carry. Additionally, other such products include multiple parts that must be entirely detached from one another to replace the bags, meaning that one part can be easily lost and render the product non-functional.

SUMMARY OF THE INVENTION

The present application addresses these shortcomings in the art by providing a novel and improved dispenser for coiled material, which is simple in its structure, and economical to manufacture or produce.

A related object of the application is to provide an improved dispenser as above characterized, which can adapt to spools having differing capacities, and to gradual changes in the size of a spool, as its contents become depleted over time.

Still another object is to provide an improved dispenser in accordance with the foregoing, which facilitates replacement of a depleted spool with a new one as required, as the content is used up.

The objects are accomplished by a dispenser for holding a spool of coiled material, comprising in combination an elongate spindle having opposite end portions, shoulder members carried at the end portions, respectively, for positioning the spool on the spindle, and an elastic line extending between said shoulder members, and comprising two coextensive line sections respectively confining the outermost convolution of said coiled material, to thereby resist the coiled material against free unwinding movement.

Other features and advantages will hereinafter appear.

In accordance with a first aspect of the invention, a dispenser for holding a spool of coiled material is provided, comprising: an elongate spindle having opposite end portions, shoulder members carried at the end portions, respectively, for positioning the spool on the spindle, at least one of the shoulder members being removable from the spindle, to allow for insertion or removal of the spool onto the spindle, and an elastic line extending between the shoulder members, and traversing an outermost convolution of the coiled material, to thereby resist the coiled material against freely unwinding movement.

In accordance with an embodiment of the dispenser, the shoulder members each have a transverse hole, and the elastic line passes through the transverse hole of each of the shoulder members.

In accordance with a further embodiment of the dispenser, the shoulder members comprise a first shoulder member and a second shoulder member, each having a transverse hole formed therethrough, and the elastic line extends into a first end of the transverse hole of the first shoulder member and exits a second end of the transverse hole, and thereafter loops back upon itself and extends into the first end of the transverse hole of the first shoulder member. The loop back portions of the elastic line may frictionally engage one another inside the transverse hole of the first shoulder member, to normally resist against inadvertent slippage of the loop back portions inside the transverse hole of the first shoulder member.

In accordance with a further embodiment of the dispenser, the elastic line further comprises two coextensive line sections respectively confining the outermost convolution of the coiled material, to thereby resist the coiled material against free unwinding movement. Both of the coextensive line sections may meet one another at one of the shoulder members, and are frictionally retained therein, to permit manual adjustment of their lengths and a distance separating the coextensive line sections as the quantity of the coiled material becomes depleted. The shoulder members may comprise a first shoulder member and a second shoulder member, each having a transverse hole formed therethrough, and the elastic line extends into one end of the transverse hole of the first shoulder member and exits the other end of the transverse hole, and thereafter loops back upon itself and extends into the other end of the transverse hole of the first shoulder member and in an opposite direction, therein forming a loop adjacent to the first shoulder member. The loop adjacent to the first shoulder member can be increased in size by pulling the loop away from the first and second shoulder member to decrease the distance separating the coextensive line sections as the quantity of the coiled material becomes depleted to continuously confine the outermost convolution of the coiled material. The loop adjacent to the first shoulder can be decreased in size to increase the distance between the coextensive line sections upon replacement of the spool of the coiled material.

In accordance with a further embodiment of the dispenser, the spool of coiled material comprises a series of bags that can be separated from the spool into individual bags.

In accordance with a further embodiment of the dispenser, the at least one removable shoulder member is press fit onto one of the end portions of the spindle. Each of the shoulder members can be removable from the spindle and are press fit onto respective end portions of the spindle.

In accordance with a further embodiment of the dispenser, the shoulder members each have a transverse hole, and the elastic line passes through the transverse hole of each of the shoulder members, and the shoulder members comprise a first shoulder member and a second shoulder member, each having transverse holes formed therethrough. The elastic line may comprise a first elongated segment, a connecting segment, a second elongated segment opposite the first elongated segment; and a loop segment opposite the connecting segment; wherein the first elongated segment feeds into the connecting segment, the connecting segment feeds into the second elongated segment, the second elongated segment feeds into the loop segment and the loop segment feeds into the first elongated segment, and wherein the loop segment comprises a first and second end, each of which are disposed in the transverse hole of the first shoulder member, and the connecting segment passes through the second shoulder member. The length of the loop segment is configured to be manually increased or decreased, wherein increasing the length of the loop segment decreases a distance between the first and second elongated segments to increase a tension applied to the spool of coiled material, and wherein decreasing the length of the loop segment increases the distance between the first and second elongated segments to increase the tension applied to the spool of coiled material.

In accordance with a second aspect of the invention, a dispenser for holding a spool of coiled material is provided, comprising: an elongate spindle having opposite end portions, shoulder members carried at the end portions, respectively, for positioning the spool on the spindle, and an elastic line extending between the shoulder members, and comprising two coextensive line sections respectively confining the outermost convolution of the coiled material, to thereby resist the coiled material against freely unwinding movement. In a further embodiment, one of the shoulder members has a transverse hole and each line section having a corresponding part extending to and passing through the transverse hole in opposition to one another, to frictionally resist relative or incidental slippage against one another.

DETAILED DESCRIPTION OF THE DRAWINGS

Figure 1:
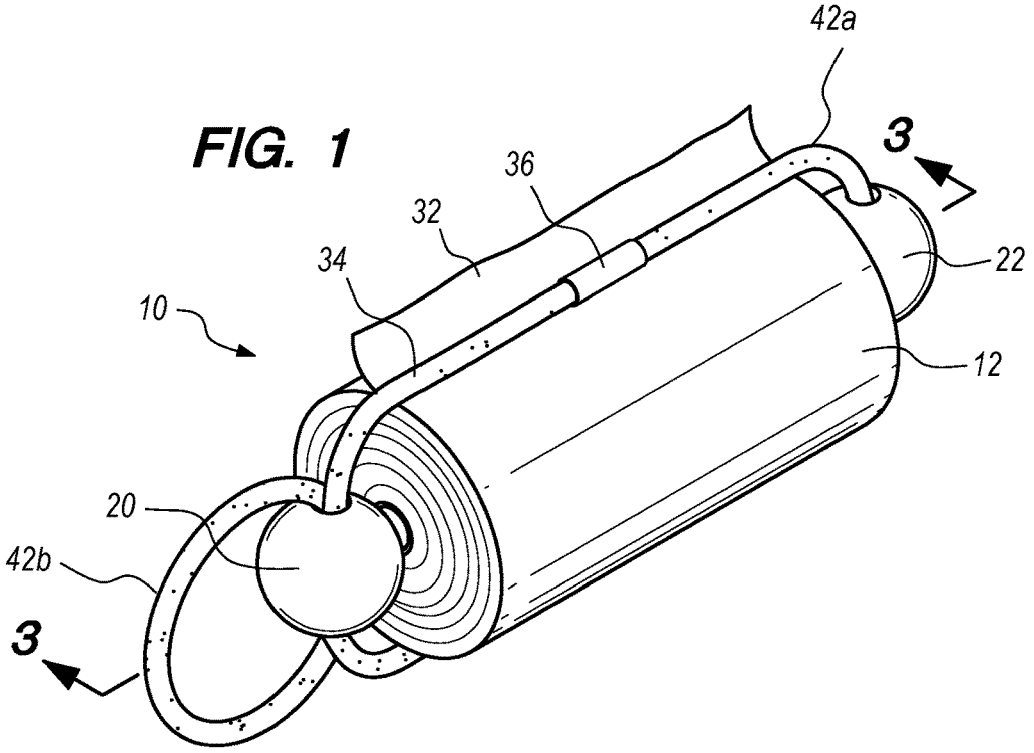
FIG. 1 is a perspective view of the improved dispenser of the present application, shown holding a spool of coiled material.
Figure 2:
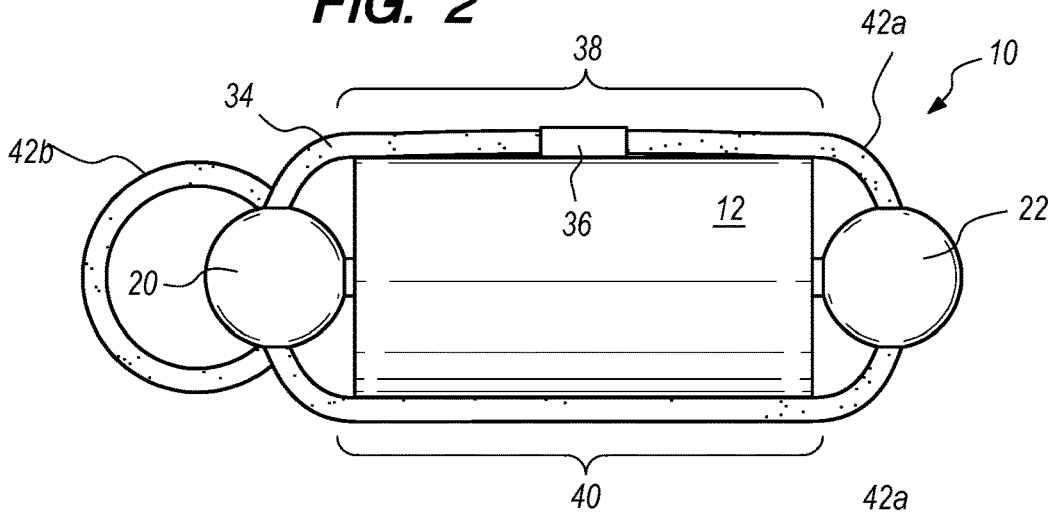
FIG. 2 is a front elevation of the dispenser of FIG. 1.
Figure 3:
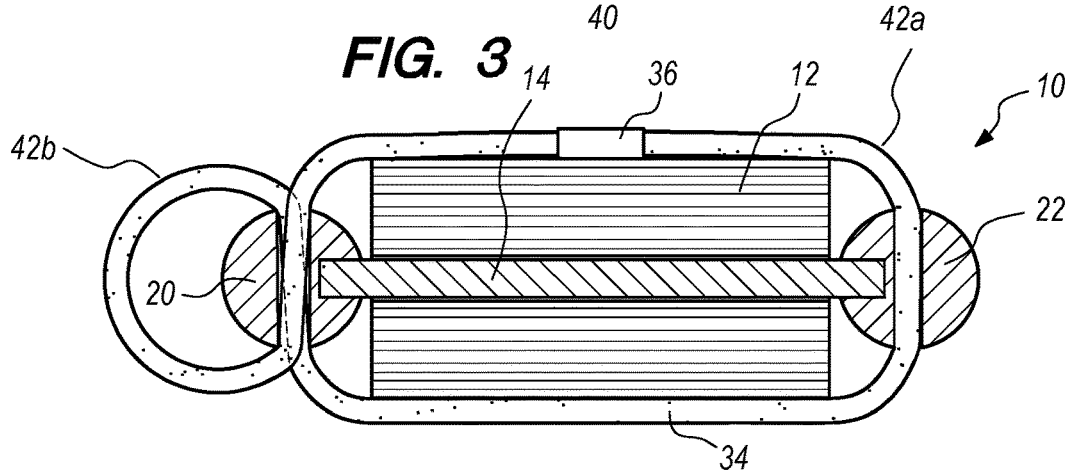
FIG. 3 is a view, partly in front elevation and partly in longitudinal cross-section, of the dispenser of FIGS. 1 and 2.

Referring to the drawings, FIGS. 1-4 illustrate the improved dispenser of the present application. The dispenser is generally designated by the numeral 10, and adapted to accept and hold in place, a spool of coiled sheet material 12, such as a continuous length of paper or of plastic bags or of another substance. Typically, there are tear lines or lines of weakness along the length of the material such that as it is being payed off, it can be separated into individual units by tearing, one at a time as needed.

Figure 5:
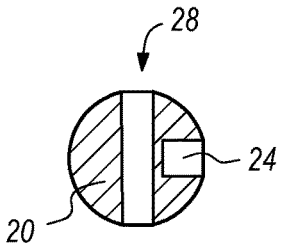
FIG. 5 is a vertical cross-sectional view of the left shoulder member of the dispenser of FIGS. 1-4.
Figure 6:
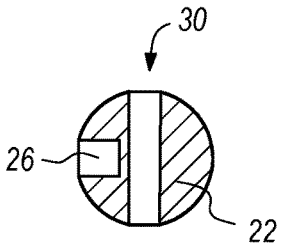
FIG. 6 is a vertical cross-sectional of the right shoulder member of the dispenser of FIGS. 1-4.

The dispenser 10 comprises an elongate spindle 14 having opposite end portions which carry shoulder members 20 and 22. The shoulder members 20, 22 are preferably press fitted on the spindle 14, such that one or both shoulder members 20, 22 can be temporarily removed to enable a fresh spool to be installed in place of a depleted spool (not shown), when necessary. As shown in FIGS. 5 and 6, each of the shoulder members 20, 22 has holes 24, 26, which receive respectively, the opposite end portions of the spindle 14. The shoulder members 20, 22 further comprise through holes 28, 30, which are through bores which receive an elastic line 34 to be described.

Figure 4:
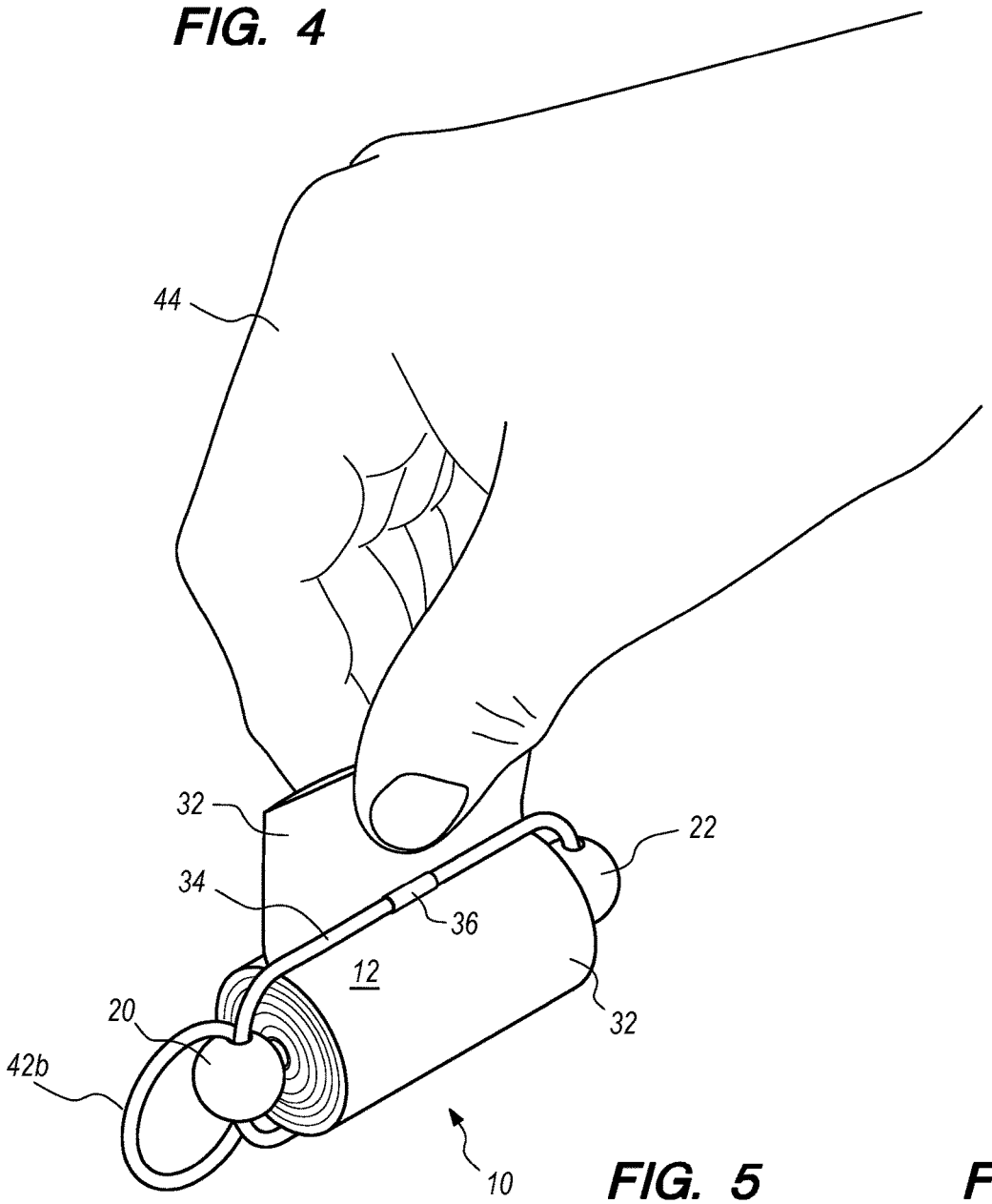
FIG. 4 is a perspective view of the dispenser of FIGS. 1-3, showing a person's hand pulling the forward edge of a spool of material as carried on the dispenser.

FIGS. 1 and 4 illustrate the outermost convolution 32 of the spool 12. The elastic line 34 is preferably a continuous loop 42*a* formed by a small crimped link or equivalent type coupling 36 of two ends of the line 34. The elasticity of line 34 further allows for the loop 42*a* to be stretched laterally when one or both shoulder members 20, 22 from the spindle 14 when replacing the spool 12. The elastic line 34 has two oppositely disposed line sections 38, 40 which are coextensive with the spool axis and extend along the outermost part of the spool 12, joining each other at the respective shoulder members 20, 22. At shoulder member 20, there are two portions of the elastic line 34 which have been passed through the member 20 and which by-pass one another, as in FIG. 3. These by-passed areas of the elastic line 34 can be made to be sufficiently tight with one another, so that incidental shifting of either part is avoided. The by-passed areas of the elastic line 34 can, however, be manually pulled past one another as required, in order to adjust the tension in the line sections 38, 40, as desired as depletion of the spool 12 occurs over time.

An additional loop 42*b* of the elastic line 34 is formed by the areas of the elastic line 34 passing through the shoulder member 20. The loop 42*b* is adjacent to the loop 42*a* and two line sections 38, 40, and manually pulling the loop 42*b* to expand the size of the loop 42*b* and reduce the size of loop 42*a*, which causes the two line sections 38, 40 to move closer together, thereby increasing the tension around the spool of coiled material 12, such as when the spool 12 is depleted over time. When a new spool 12 is being inserted, manually pulling one or both of the line sections 38, 40 (i.e., increasing the size of loop 42*a* and reducing the size of loop 42*b*), which reduces the tension applied by the line sections 38, 40 to the spool 12, allowing a larger spool 12 to be applied.

Also, the additional loop 42 that is provided to the left of shoulder member 20 can be used to suspend the dispenser 10, if desired, from a hook or nail in a wall (not shown).

In operation, FIG. 4 shows a person's hand 44, grasping the edge of the outermost convolution 32 from the spool 12, and in preparation to tear individual portions, seriatim, from the spool 12. During use of the dispenser 10, as noted previously, the spool 12 resists any tendency for uncontrollable unwinding of the coil 12 by the provision of dual line sections 38, 40 that loosely engage this outermost convolution at diametrically opposed areas of the spool 12. An especially neat appearance is realizable, and with the relatively small size, the dispenser 10 can conveniently fit in the pocket of the user until needed.

The dispenser 10 is simple in its structure, and economical to manufacture and produce. It significantly simplifies storage and dispensing of coiled material from a spool 12, and virtually eliminates random or uncontrolled unwinding of the spool 12, for an especially neat packaging design. It thus represents a distinct advance and improvement in the dispenser field.

As used herein, directional or positional terms such as "front", "left", "right", etc., are used for explanatory purposes only to describe the dispenser 10 and elements having the orientation shown on the page for example in FIGS. 1-6.

While there have been shown and described and pointed out fundamental novel features of the invention as applied to embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice.

What is claimed:

1. A dispenser for holding a spool of coiled material, comprising:

an elongate spindle having opposite end portions, shoulder members carried at the end portions, respectively, for positioning the spool on said spindle, at least one of said shoulder members being removable from said spindle, to allow for insertion or removal of the spool onto the spindle, and an elastic line extending between said shoulder members, and traversing an outermost convolution of said coiled material, to thereby resist the coiled material against freely unwinding movement;

wherein said shoulder members comprise a first shoulder member and a second shoulder member, each having a transverse hole formed therethrough, and said elastic line extends into a first end of the transverse hole of the first shoulder member and exits a second end of said transverse hole, and thereafter loops back upon itself and extends through the first end of said transverse hole of said first shoulder member.

2. The dispenser of claim 1, wherein:

said elastic line passes through the transverse hole of each of said shoulder members.

3. The dispenser of claim 1, wherein:

loop back portions of the elastic line frictionally engage one another inside said transverse hole of said first shoulder member, to normally resist against inadvertent slippage of said loop back portions inside said transverse hole of said first shoulder member.

4. The dispenser of claim 1, wherein:

said elastic line further comprises two coextensive line sections respectively confining the outermost convolution of said coiled material, to thereby resist the coiled material against free unwinding movement.

5. The dispenser of claim 4, wherein:

both of said coextensive line sections meet one another at one of said shoulder members, and are frictionally retained therein, to permit manual adjustment of their lengths and a distance separating said coextensive line sections as the quantity of the coiled material becomes depleted.

6. The dispenser of claim 5, wherein:

said elastic line extends into the second end of said transverse hole of said first shoulder member and in an opposite direction, therein forming a loop adjacent to said first shoulder member.

7. The dispenser of claim 6, wherein:

the loop adjacent to the first shoulder member can be increased in size by pulling the loop away from the first and second shoulder member to decrease said distance separating said coextensive line sections as the quantity of the coiled material becomes depleted to continuously confine the outermost convolution of said coiled material.

8. The dispenser of claim 7, wherein:

the loop adjacent to the first shoulder can be decreased in size to increase the distance between said coextensive line sections upon replacement of the spool of said coiled material.

9. The dispenser of claim 1, wherein:

the spool of coiled material comprises a series of bags that can be separated from the spool into individual bags.

10. The dispenser of claim 1, wherein:

said at least one removable shoulder member is press fit onto one of the end portions of the spindle.

11. The dispenser of claim 10:

wherein each of the shoulder members are removable from the spindle and are press fit onto respective end portions of the spindle.

12. A dispenser for holding a spool of coiled material, comprising:

an elongate spindle having opposite end portions, shoulder members carried at the end portions, respectively, for positioning the spool on said spindle, at least one of said shoulder members being removable from said spindle, to allow for insertion or removal of the spool onto the spindle, and an elastic line extending between said shoulder members, and traversing an outermost convolution of said coiled material, to thereby resist the coiled material against freely unwinding movement;

said shoulder members comprise a first shoulder member and a second shoulder member, each having transverse holes formed therethrough;

wherein the elastic line comprises:

a first elongated segment, a connecting segment, a second elongated segment opposite the first elongated segment; and a loop segment opposite the connecting segment;

wherein the first elongated segment feeds into the connecting segment, the connecting segment feeds into the second elongated segment, the second elongated segment feeds into the loop segment and the loop segment feeds into the first elongated segment, and wherein the loop segment comprises a first and second end, each of which are disposed in the transverse hole of the first shoulder member, and the connecting segment passes through the second shoulder member.

13. The dispenser of claim 12, wherein the length of the loop segment is configured to be manually increased or decreased, wherein increasing the length of the loop segment decreases a distance between the first and second elongated segments to increase a tension applied to the spool of coiled material, and wherein decreasing the length of the loop segment increases the distance between the first and second elongated segments to increase the tension applied to the spool of coiled material.

14. A dispenser for holding a spool of coiled material, comprising:

an elongate spindle having opposite end portions, shoulder members carried at the end portions, respectively, for positioning the spool on the spindle, and an elastic line extending between said shoulder members, and comprising two coextensive line sections respectively confining the outermost convolution of said coiled material, to thereby resist the coiled material against freely unwinding movement;

wherein said shoulder members comprise a first shoulder member and a second shoulder member, each having a transverse hole formed therethrough, and said elastic line extends into a first end of the transverse hole of the first shoulder member and exits a second end of said transverse hole, and thereafter loops back upon itself and extends through the first end of said transverse hole of said first shoulder member.

15. The dispenser of claim 14, wherein:

each line section comprises a corresponding part extending to and passing through said transverse hole in opposition to one another, to frictionally resist relative or incidental slippage against one another.

* * * * *